US010822890B2

(12) United States Patent
Rus

(10) Patent No.: US 10,822,890 B2
(45) Date of Patent: Nov. 3, 2020

(54) PIPE HANDLING APPARATUS

(71) Applicant: Rus-Tec Engineering, Ltd., Spruce Grove (CA)

(72) Inventor: Gustaaf Rus, Spruce Grove (CA)

( * ) Notice: Subject to any disclaimer, the term of this patent is extended or adjusted under 35 U.S.C. 154(b) by 0 days.

(21) Appl. No.: 16/009,446

(22) Filed: Jun. 15, 2018

(65) Prior Publication Data

US 2019/0383109 A1 Dec. 19, 2019

(51) Int. Cl.
*E21B 19/24* (2006.01)
*E21B 19/15* (2006.01)
*E21B 19/02* (2006.01)

(52) U.S. Cl.
CPC ..... *E21B 19/155* (2013.01); *E21B 19/02* (2013.01)

(58) Field of Classification Search
CPC ... B25J 9/0018; B25J 9/04; B25J 18/00; B25J 18/025; B25J 18/04; E21B 19/24; E21B 17/1057; F16H 2001/2881
See application file for complete search history.

(56) References Cited

U.S. PATENT DOCUMENTS 3,066,805 A * 12/1962 Sullivan ..... B25J 5/04 414/728
3,108,498 A * 10/1963 Hedin ..... B25J 5/04 475/5
3,247,979 A * 4/1966 Melton ..... B25J 5/04 414/735
3,272,347 A * 9/1966 Lemelson ..... B25J 9/0093 414/728
3,370,213 A * 2/1968 Rose ..... B25J 13/082 318/513
3,792,782 A * 2/1974 Melton ..... B66C 13/18 414/741
3,904,042 A * 9/1975 Colston ..... B25J 3/04 414/1
4,077,525 A 3/1978 Callegari et al.
4,172,664 A 10/1979 Jenkins
4,274,778 A 6/1981 Putnam et al.
4,370,091 A * 1/1983 Gagliardi ..... B23Q 1/5481 414/4
4,501,522 A * 2/1985 Causer ..... B25J 3/04 414/4
4,643,624 A 2/1987 Murphee
4,668,155 A * 5/1987 Kaufmann ..... B25J 9/046 414/680
4,762,455 A * 8/1988 Coughlan ..... B25J 3/04 376/248

(Continued)

FOREIGN PATENT DOCUMENTS

CN 104314480 A * 1/2015

*Primary Examiner* — Gregory W Adams
(74) *Attorney, Agent, or Firm* — Bushman Werner, P.C.

(57) ABSTRACT

A tailing arm mountable on a mast of an oil/gas rig and having a housing, a first arm rotatable relative to the housing, a second telescoping arm pivotally connected to the first, and third arm pivotally connected to the second arm. A roller on the end of the third arm receives and guides pipes being moved on to or off of the rig. A first rotation assembly controls the rotation of the first arm relative to the housing. A second rotation assembly rotates the housing relative to the mast. The tailing arm can be used to load pipe from multiple sides of the rig and to rack the pipe in the setback.

13 Claims, 12 Drawing Sheets

(56) References Cited

U.S. PATENT DOCUMENTS

| | | | | |
|---|---|---|---|---|
| 4,828,453 | A * | 5/1989 | Martin | B25J 9/06 414/738 |
| 5,193,973 | A * | 3/1993 | Tubke | B65G 57/00 108/52.1 |
| 5,606,235 | A * | 2/1997 | Mauletti | B25J 9/046 318/625 |
| 7,117,938 | B2 | 10/2006 | Hamilton et al. | |
| 7,445,050 | B2 * | 11/2008 | Kuttel | E21B 19/06 166/380 |
| 7,552,775 | B2 | 6/2009 | Pietras | |
| 8,028,748 | B2 * | 10/2011 | Laitolais, Jr. | E21B 41/0021 166/77.51 |
| 8,171,818 | B2 * | 5/2012 | Tokumitsu | B25J 9/026 408/234 |
| 8,800,716 | B2 * | 8/2014 | Morelli | B66F 11/04 175/219 |
| 8,839,881 | B1 | 9/2014 | Baumier | |
| 8,931,999 | B2 * | 1/2015 | Dorner | B21D 43/24 414/797 |
| 9,243,461 | B1 | 1/2016 | Barnes | |
| 2008/0168639 | A1 * | 7/2008 | Otake | B25J 5/02 29/56.6 |
| 2016/0305203 | A1 | 10/2016 | Guerra | |
| 2017/0268302 | A1 * | 9/2017 | Orr | F16L 1/207 |

* cited by examiner

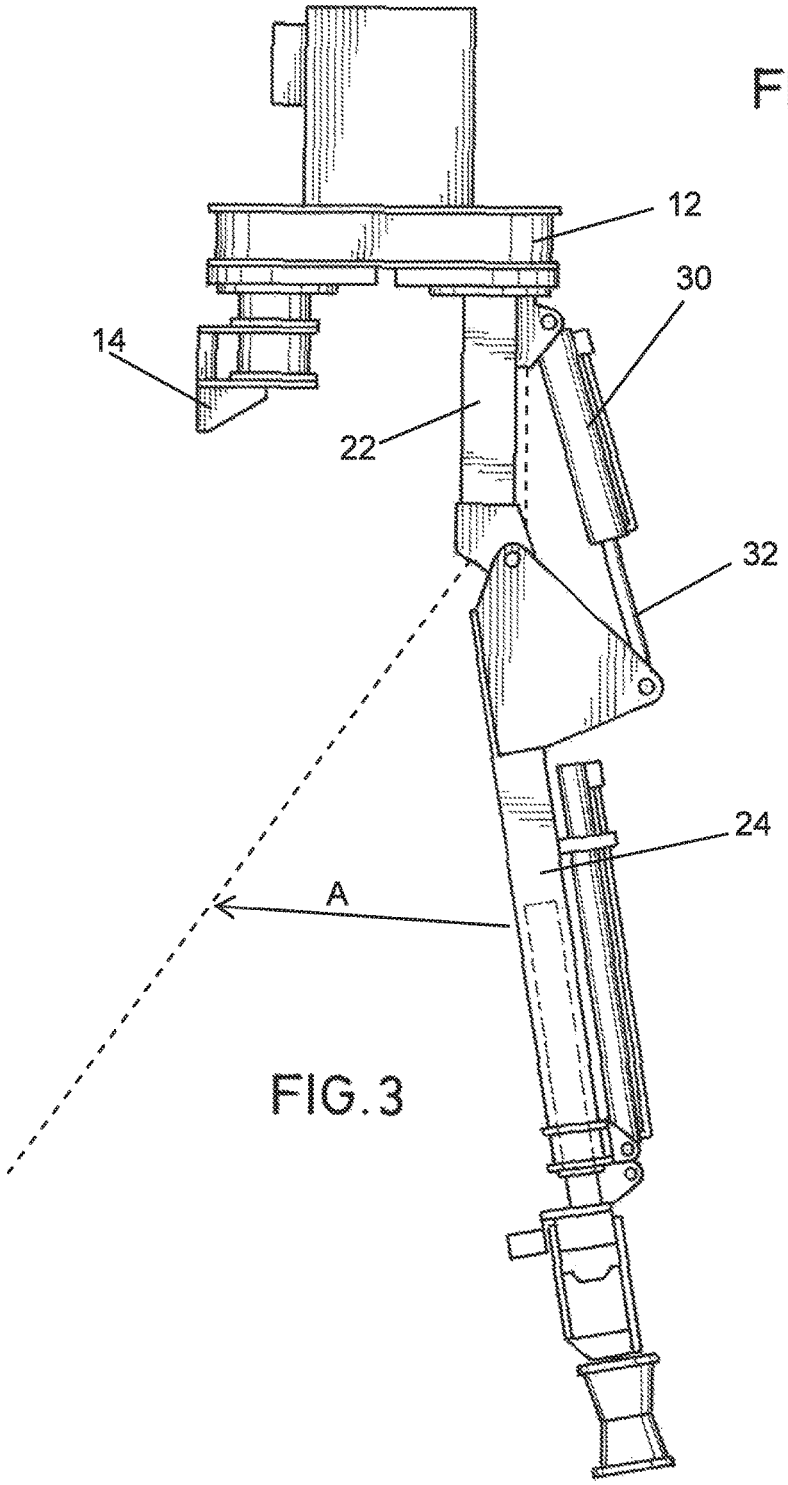
FIG. 3
FIG. 4
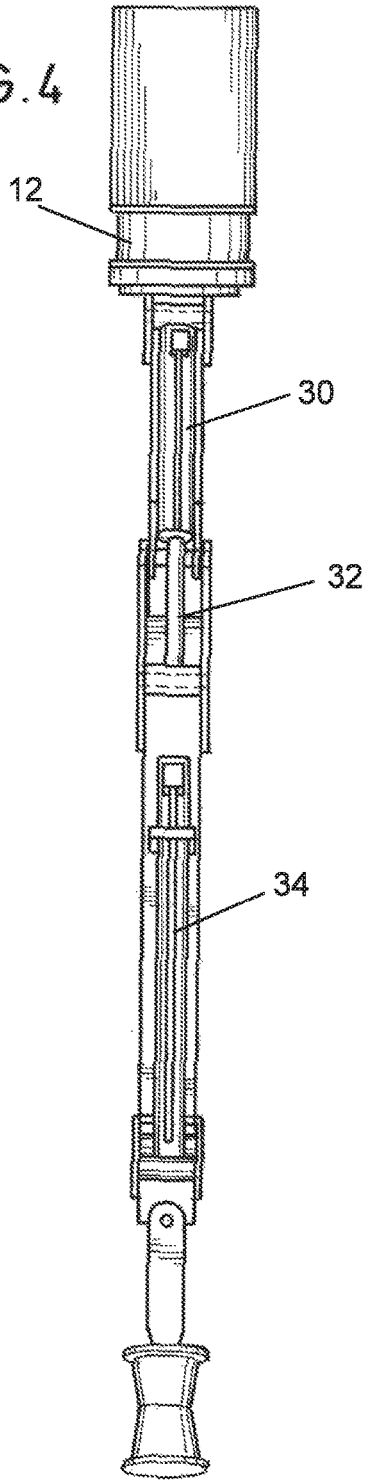

PIPE HANDLING APPARATUS

FIELD OF THE INVENTION

The present invention relates to a pipe handling apparatus and, in particular, relates to an apparatus for tailing in and racking pipe on a drill rig.

BACKGROUND OF THE INVENTION

A conventional land based drilling rig comprises an elevated platform having four primary sides; the front, the back, the drillers side, and the off-drillers side. Generally, the drilling rig equipment buildings are located on ground level on the back side (or backyard), the driller's cabin or doghouse, fluid pumps buildings and other associated buildings are on the driller's side, and drilling fluid tanks are on the off-drillers side. The front side is usually free of equipment, buildings, etc.

Most land based drilling rigs use a pipe conveying system for moving tubulars from a horizontal position to a vertical position on the drill floor. This system is conventionally positioned along the front side of the rig. The pipe is moved to the rig floor using a V-door ramp and catwalk system. An elevator is used to lift one end of the tubular pipe. The pipe can then be positioned over well center for drilling or set back in the fingerboard for later use. When the upper end of the pipe is lifted by the elevator, the lower end of the pipe is hanging freely and unsupported. Guide ropes or the like can be used by rig personnel to manually position the lower end of the pipe. Alternatively, a tailing arm (sometimes called a tail-in arm) can be used to guide the lower portion of the pipe.

Tailing arms are used to guide the lower end of the pipes while they are raised by the elevator. Prior art tailing arms are positioned either on the rig floor or on the catwalk near the V-door. They generally move by pivoting, sliding, or both in one direction, i.e., the direction from the V-door to well center. Those tailing arms positioned on the rig floor take up space and present a tripping hazard for rig personnel. The limited movement of the tailing arms, whether on the rig floor or the catwalk means they cannot be used to guide the lower ends of pipes in the setback or in other pipe handling operations not located over well center.

SUMMARY OF THE INVENTION

In one aspect, the present invention relates to a tailing arm mountable on a rig mast for guiding pipe to well center.

In another aspect, the present invention relates to a rotatable tailing arm mountable on a rig mast for guiding pipe from the front side or the drillers side of the rig to well center.

In yet another aspect, the present invention relates to a rotatable tailing arm mountable on a rig mast for guiding pipe to well center and racking pipe in the setback.

These and further features and advantages of the present invention will become apparent from the following detailed description, wherein reference is made to the figures in the accompanying drawings.

BRIEF DESCRIPTION OF THE DRAWINGS

FIG. 3 is a side elevational view of the tailing arm of FIG. 1.

FIG. 4 is a front elevational view of the tailing arm shown in FIG. 3.

DETAILED DESCRIPTION OF PREFERRED EMBODIMENTS

As used herein, the term "pipe" will be used to refer generally to any tubular member which may be handled on a rig during drilling, completing and/or production operations, including drill pipe, tubing, and casing.

Figures 1, 5:
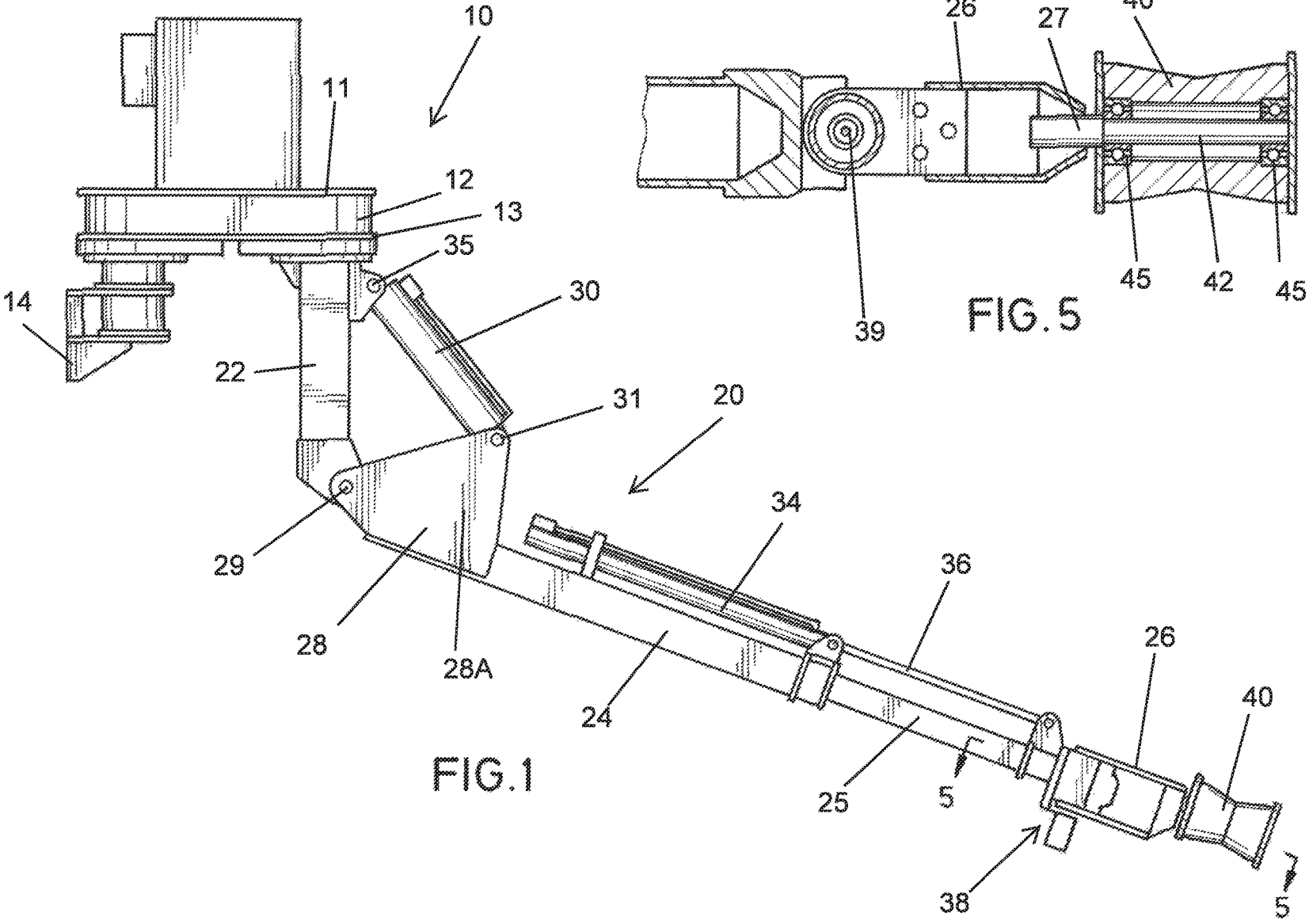
FIG. 1 is a side elevational view of one embodiment of the tailing arm of the present invention in one position.
FIG. 5 is a cross-sectional view taken along the lines 5-5 of FIG. 1.

Turning to FIG. 1 there is shown one embodiment of the tailing arm of the present invention. The tailing arm assembly, shown generally as 10, includes a housing 12, a mount 14 for attaching the tailing arm assembly 10 to the mast of a drill rig, and an arm assembly 20. Housing 12 has upper wall 11, lower wall 13, and holds first and second rotation assemblies, the details and operation of which will be described more fully hereafter.

Figure 2:
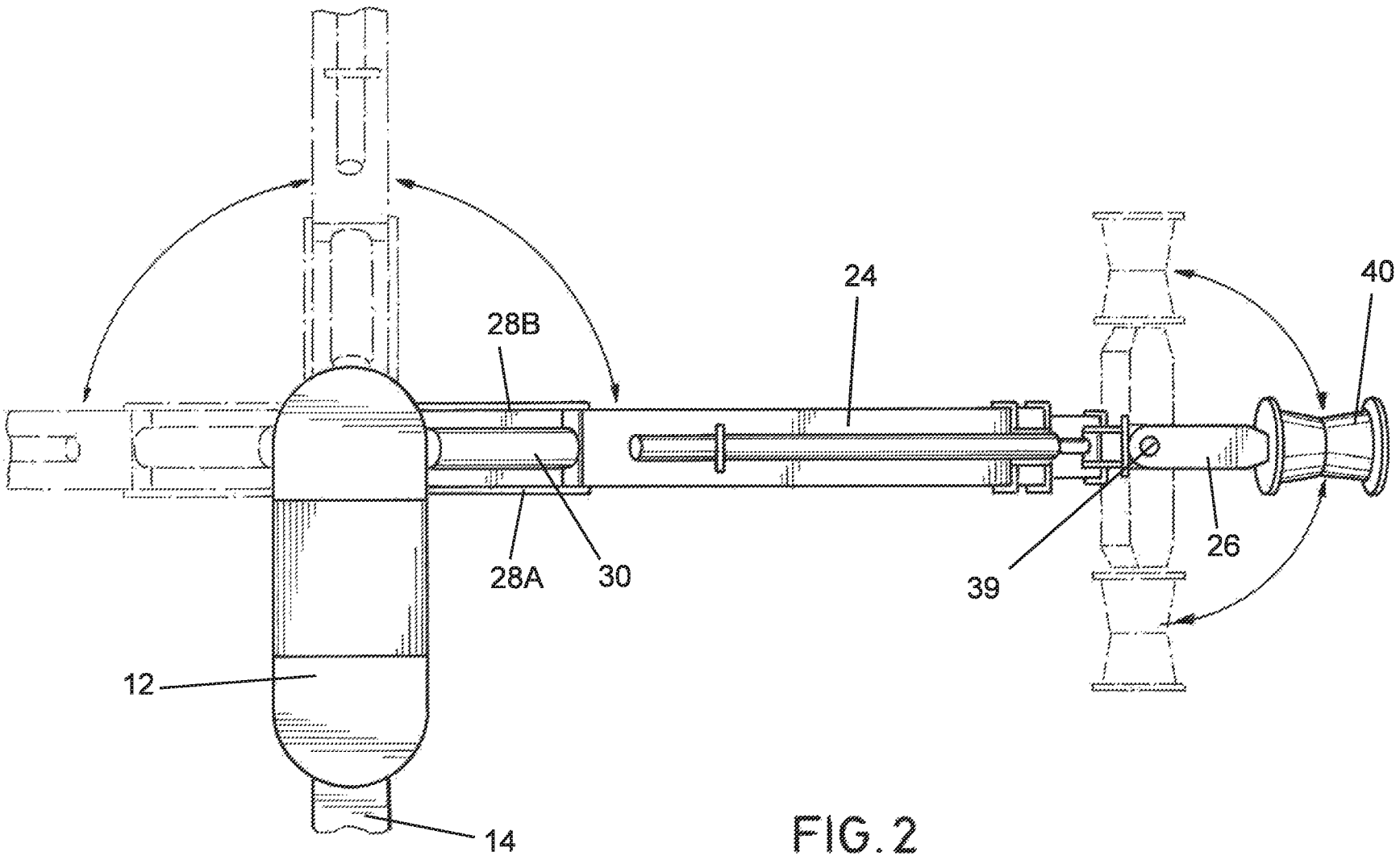
FIG. 2 is a top view of the tailing arm of FIG. 1.

Arm assembly 20 is generally made up of first arm 22, second arm 24, and third arm or wrist 26. First arm 22 is rotatably connected to housing 12. There is an elbow joint 28 between first arm 22 and second arm 24. As shown in FIG. 2, elbow 28 comprises two spaced plates 28A and 28B. Plates 28A and 28B are pivotally connected to first arm 22 by pin 29. A first piston/cylinder assembly 30 is disposed between first arm 22 proximate housing 12 and elbow joint 28. As seen in FIG. 3, piston rod 32 of first piston assembly 30 extends and retracts to pivot second arm 24 relative to first arm 22. In a preferred embodiment, piston rod 32 is pivotally connected to elbow 28 by pin 31. It will be understood that piston rod 32 may be connected directly to second arm 24 by means well known to those skilled in the art. Piston assembly 30 is connected at its upper end to first arm 22 via bracket 33 and pin 35.

Figure 7:
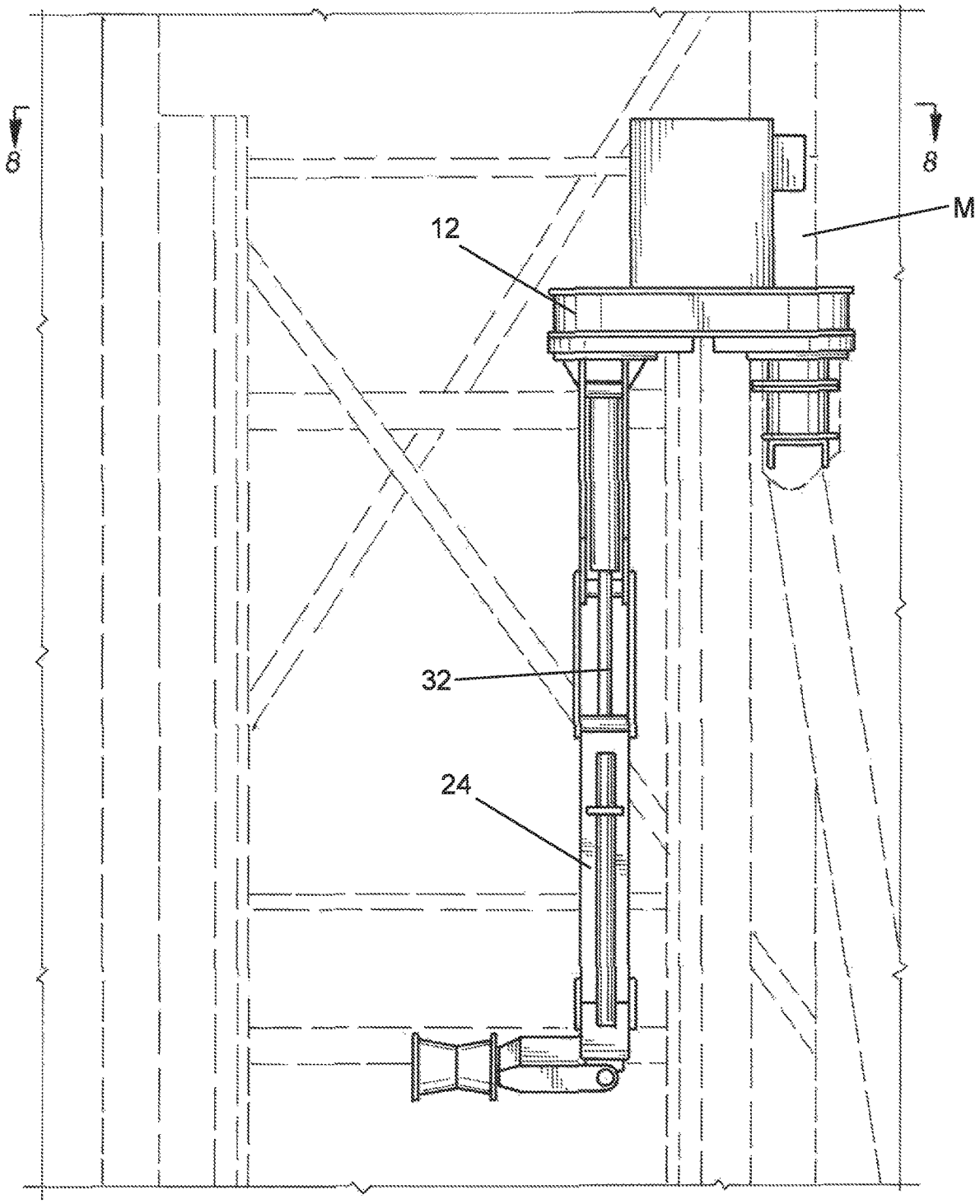
FIG. 7 is an environmental view showing the tailing arm of FIG. 1 on a rig mast in the position for transportation of the rig.
Figure 13:
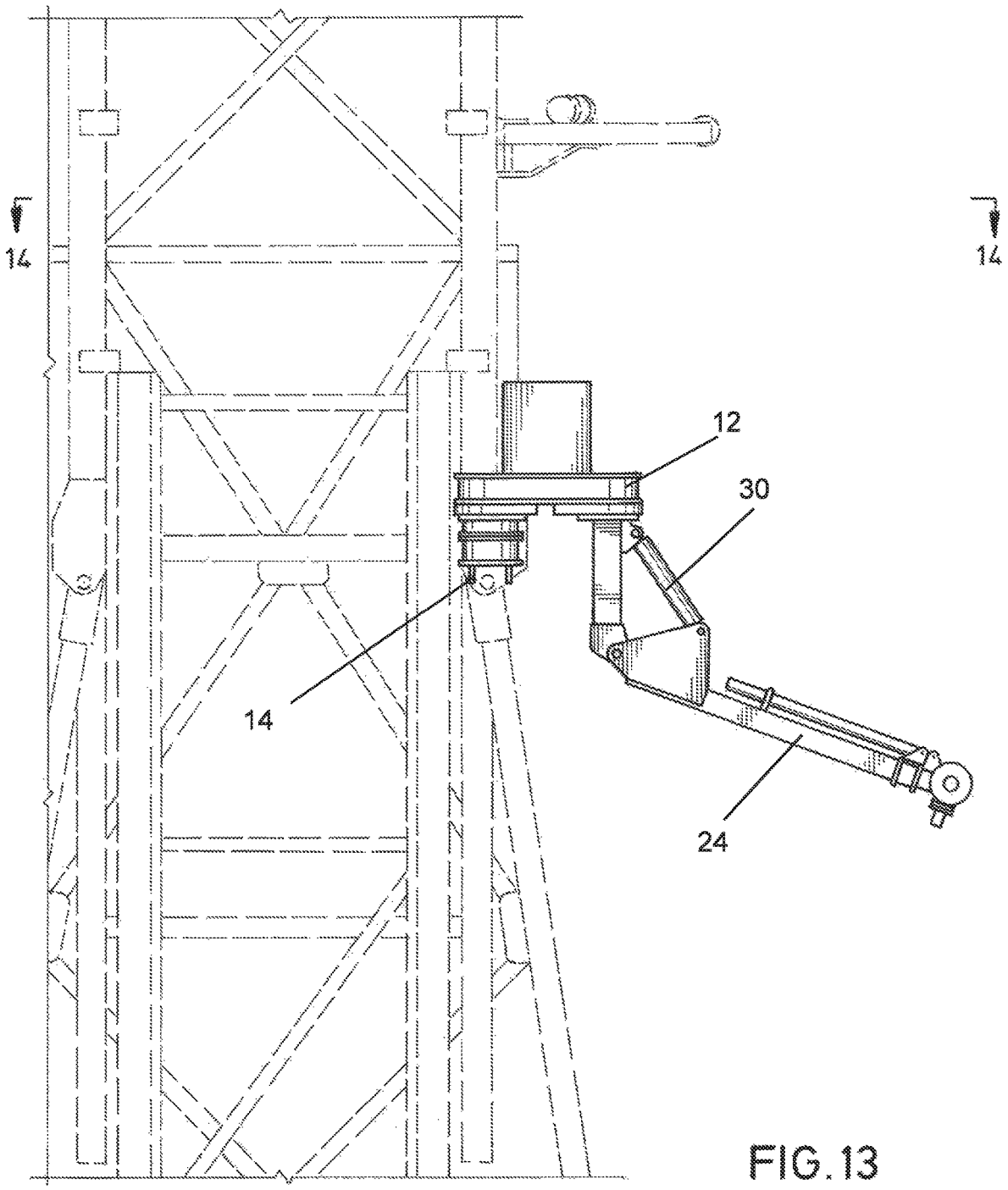
FIG. 13 is an environmental view showing the tailing arm of FIG. 1 in position for non-pipe handling operations.

In a preferred embodiment, and as shown in FIG. 1, second arm 24 comprises a telescoping arm with inner arm 25 extending out of second arm 24. A second piston/cylinder assembly 34 is connected to second arm 24 and inner arm 25 by means well known to those of skill in the art. Piston rod 36 of piston assembly 34 is connected to and operative to extend and retract inner arm 25. FIGS. 3, 7, and 13 show arm assembly 20 with inner arm 25 in the fully retracted position. As shown in FIG. 1 while the telescoping of second arm 24 is accomplished with a single inner arm 25, the same may be accomplished with a plurality of decreasingly sized arms/arm segments which telescopically nest in one another.

First and second piston assemblies 30 and 34 can be hydraulic, pneumatic, or mechanically operated in a manner well known to those skilled in the art. In a preferred embodiment, first and second piston assemblies 30 and 34 are hydraulic.

Wrist 26 is pivotally connected to inner arm 25 of arm assembly 20. It be understood that in an embodiment in which arm 24 does not telescope, wrist 26 would be pivotally connected to arm 24. Wrist 26 pivots around pin 39 by means of a hydraulic rotary actuator shown generally as 38.

As seen in FIG. 5, a roller 40 is mounted on the end of wrist 26. Roller 40 has a cylinder in which is disposed rod 42. Roller 40 is supported on rod 42 by a plurality of radial bearings 45 which allow roller 40 to rotate freely about rod 42. Rod 42 is connected to wrist 26 by connection rod 27. Alternatively, rod 42 may connect directly to wrist 26. The outer surface of roller 40 is generally hourglass shaped to accommodate and cradle the pipes as they are lifted.

Turning now to FIG. 2, there is shown the range of rotation of arm 22. Arm 22 can rotate to move arm assembly 20 through 180° of rotation. While the arm position is shown in phantom at points 90° apart, it will be understood that the rotation can stop anywhere along the 180° travel path. Similarly, wrist 26 can pivot through a full 180° range relative to arm 24.

Turning to FIGS. 3 and 4, there is shown the tailing arm assembly 10 with piston rod 32 extended and piston rod 36 retracted. It will be understood that arm assembly 20 can be pivoted further in the direction of arrow A by pivoting piston assembly 30 downwardly while extending piston rod 32.

Figure 6:
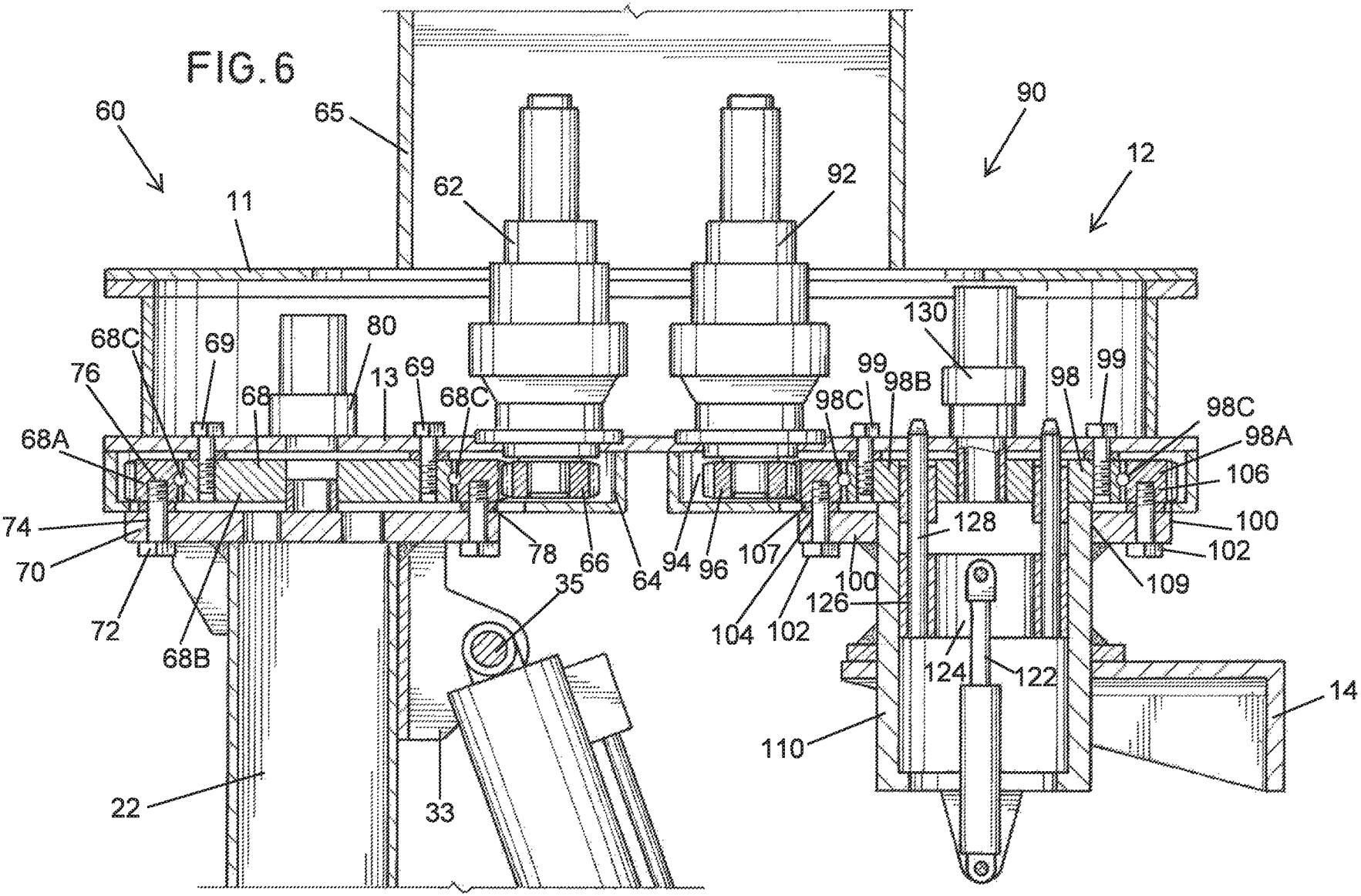
FIG. 6 is an elevational view, partly in section of the rotation assemblies of the tailing arm of the present invention.

FIG. 6 shows first and second rotation or drive assemblies 60 and 90, respectively. First rotation assembly 60 drives the rotation of arm 22 of arm assembly 20. Second rotation assembly 90 drives the rotation of housing 12. Positioned above housing 12 is motor box 65 having a motor (not shown) of a type well known to those skilled in the art.

First rotation assembly 60 includes first drive shaft 62 which extends through upper wall 11 of housing 12 into motor box 65, and down through lower wall 13 of housing 12 into first gear housing 64. First gear housing 64 can be affixed to lower wall 13 by welding or other well known means. Disposed within first gear housing 64 are gear 66 and slewing ring 68. Slewing ring 68 is made up of outer ring 68A and inner ring 68B. There are a plurality of circumferentially spaced ball bearings 68C between outer ring 68A and inner ring 68B. A plurality of circumferentially spaced bolts 69 extend through inner ring 68B and through lower wall 13 of housing 12.

Positioned below first gear housing 64 is first plate 70. Plate 70 is connected to outer ring 68A by a plurality of screws 72 which extend through bores 74 in plate 70 and into threaded blind bores 76 in outer ring 68A. Washers or other spacers 78 may be positioned between plate 70 and outer ring 68A. First arm 22 is affixed to plate 70 by welding or other means well known to those skilled in the art.

To rotate arm 22, the motor (not shown) turns drive shaft 62 and first gear 66 which in turn, engages with and drives outer ring 68A. As outer ring 68A rotates, plate 70, and thus arm 22 are rotated. Inner ring 68B is held in place by bolts 69. In preferred embodiments, first rotation assembly 60 includes an encoder 80 which tracks the rotational position of arm 22 to improve the control and precision of the operation.

It will be appreciated that the embodiment shown in FIG. 6 of the first rotation assembly is a preferred embodiment. Slewing ring 68 may be replaced with a single gear which is held by bolts 72 and which rotates plate 70 and arm 22 when engaged by first gear 66.

Second rotation assembly 90 is similar in some respects to first rotation assembly 60. Drive shaft 92 extends through upper and lower walls 11 and 13 of housing 12 into second gear housing 94. Third gear 96 and fourth gear or stewing ring 98 are disposed in housing 94. Slewing ring 98 is made up of outer ring 98A and inner ring 98B. There is a plurality of circumferentially spaced ball bearings 98C positioned between rings 98A and 98B. Below gear housing 94 is a second plate 100 which is connected to outer ring 98A by screws 102 which extend through bores 104 in plate 100 and into threaded blind bores 106 in outer ring 98A. Washers or other spacers 107 may separate plate 100 from outer ring 98A. There are a plurality of circumferentially spaced bolts 99 which extend through inner ring 98B and through lower wall 13 of housing 12.

Plate 100 has an annular opening 109 through which extends piston chamber 110. Piston chamber can be affixed to plate 100 by welding or other means. Piston assembly 120 includes piston rod 122 and piston 124. Piston 124 has a plurality of circumferentially spaced bores 126 through which extend pins 128. Inner ring 98B and lower wall 13 of housing 12 each have bores in register with bores 126. When piston rod 122 is extended, piston 124 is pushed up and pins 128 pass through the bores in inner ring 98B and wall 13 into housing 12.

To rotate housing 12, piston 124 is first lowered so that pins 128 are retracted down into piston chamber 110. The motor (not shown) turns drive shaft 92 and first gear 96 which in turn, engages with and drives outer ring 98A. Unlike in the first rotation assembly, outer ring 98A is connected to plate 100 which does not rotate. Screws 102 hold outer ring 98A in position relative to fixed plate 100. Because outer ring 98A is not free to turn, instead inner ring 98B turns. Bolts 99 which extend through inner ring 98B and lower wall 13 of housing 12 cause housing 12 to turn along with inner ring 98B. Once housing 12 is rotated into position, piston 124 can be activated again to raise pins 128 to extend through inner ring 98B and lower wall 13 of housing 12. In this position, pins 128 prevent further rotation of inner ring 98B and housing 12.

In a preferred embodiment, piston 124 has four pins 128 spaced symmetrically 90° from each other. With this configuration, housing 12 can move 90° and then be locked in position again. The invention is not so limited though and can include varying number of pins such that housing 12 can be locked in position at different angles.

In preferred embodiments, second rotation assembly 90 includes an encoder 130 to track the rotational position of housing 12 and improve the control and precision of the operation.

Figure 8:
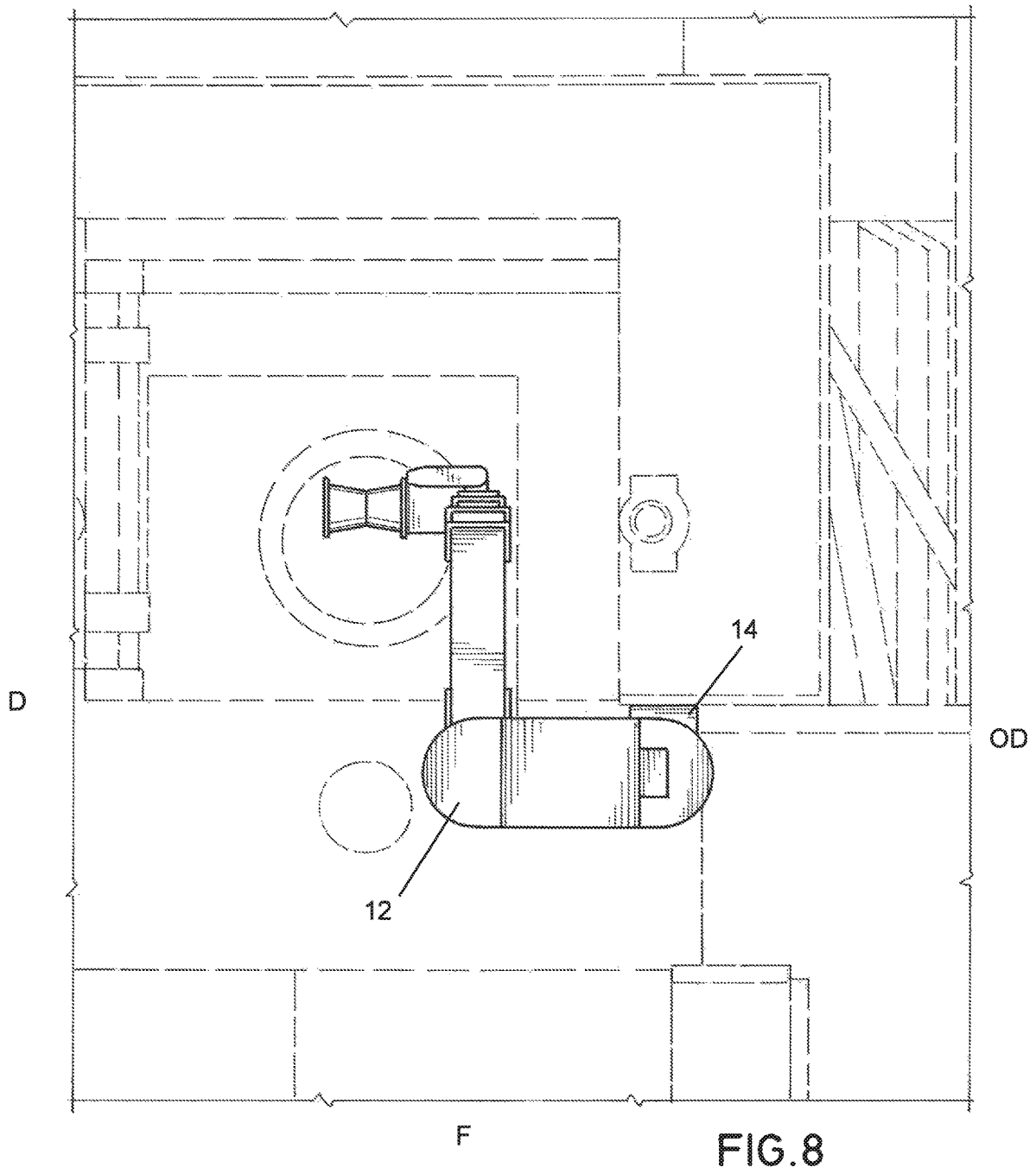
FIG. 8 is a view taken along the lines 8-8 of FIG. 7.

Turning now to FIGS. 7-14, there is shown the tailing arm 10 of the present invention mounted on a rig mast M. The various orientations/configurations of the tailing arm 10 are shown. It will be appreciated that in the various views of FIGS. 7-14, the tailing arm 10 is always mounted in the same position on the mast. The drillers side D, front side F, and off-drillers side OD are labeled for clarification. In FIGS. 7 and 8, the tailing arm 10 is shown in a configuration for transportation. Housing 12 is rotated to extend toward the drillers side D of the rig. Arm assembly 20 is rotated to be positioned generally over well center. Piston rod 32 is extended so that arm assembly 20 extends substantially straight down.

Figure 9:
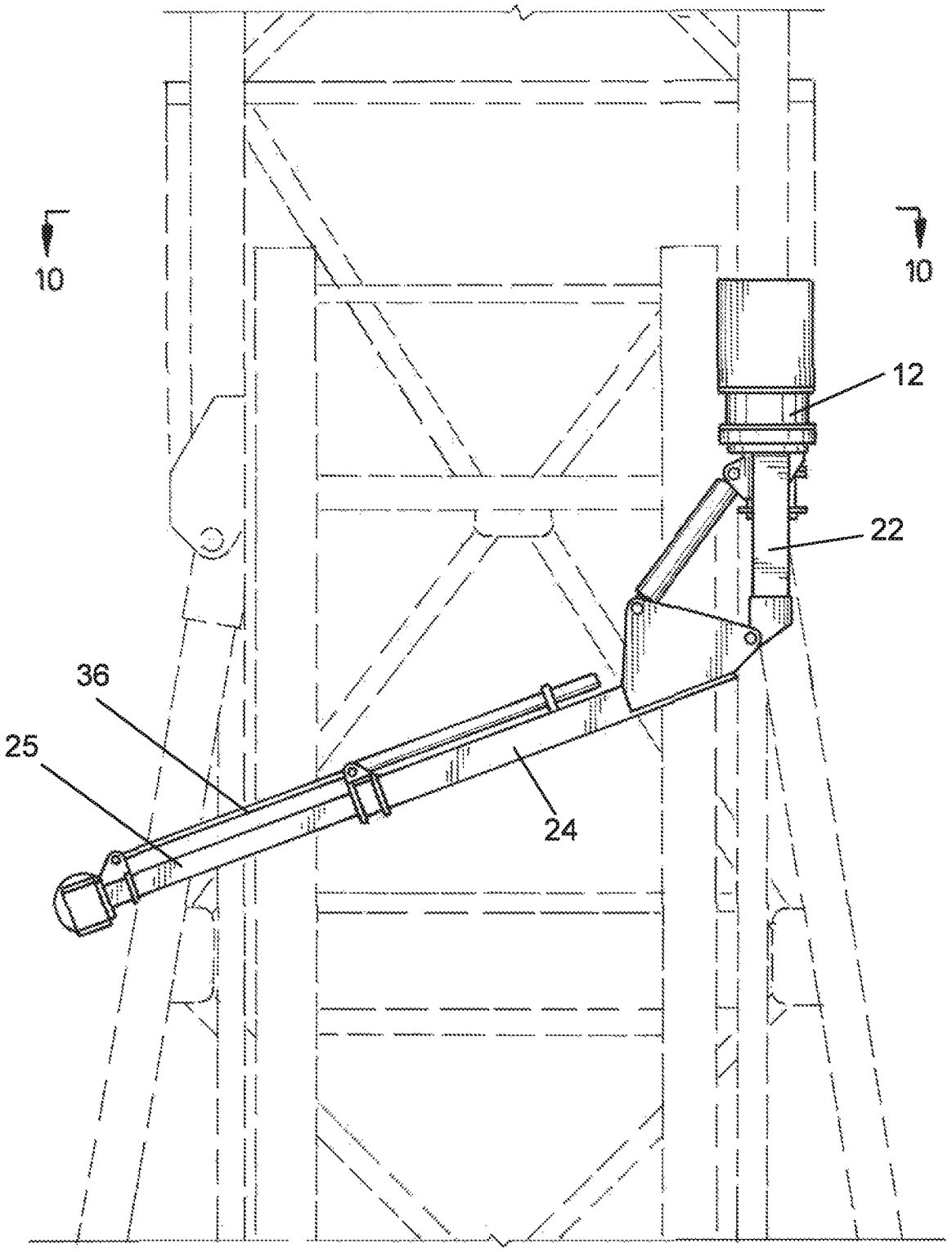
FIG. 9 is an environmental view showing the tailing arm of FIG. 1 in position for receiving pipe from the drillers side of the rig.
Figure 10:
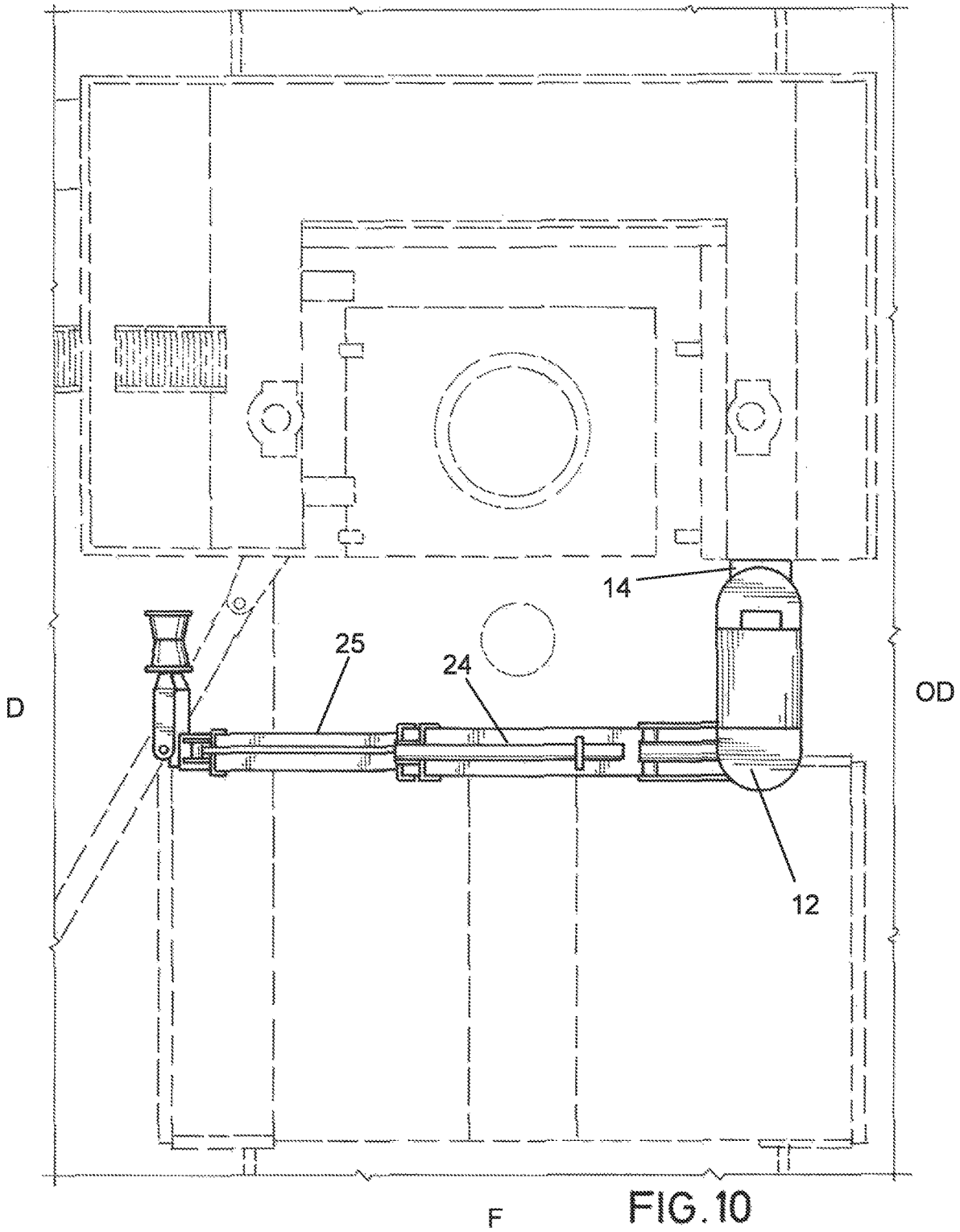
FIG. 10 is a view taken along the lines 10-10 of FIG. 9.

In FIGS. 9 and 10, the tailing arm 10 is shown in a position to receive pipe from the drillers side D of the rig. Housing 12 is rotated to extend toward the front side F of the rig. Arm assembly 20 extends toward the drillers side D. As best seen in FIG. 9, piston rod 32 is retracted while piston rod 36 is extended. The catwalk (not shown) would be positioned on the drillers side D. In operation, pipe lifted by the elevator (not shown) passes over tailing arm 10, in particular over roller 40. When the elevator has lifted the pipe to a desired height, and the pipe is resting on roller 40, piston rod 32 extends to pivot arm assembly 20 downwardly and thereby guide the lower end of pipe until the pipe is in a generally vertical position. By guiding the lower end of the pipe downward, the tailing arm prevents the pipe from swinging freely and causing damage or injury to the rig or personnel, respectively. It will be understood that the starting position shown in FIG. 9 is one such example. The exact angle and rotation of the tailing arm can be adjusted as needed.

Figure 11:
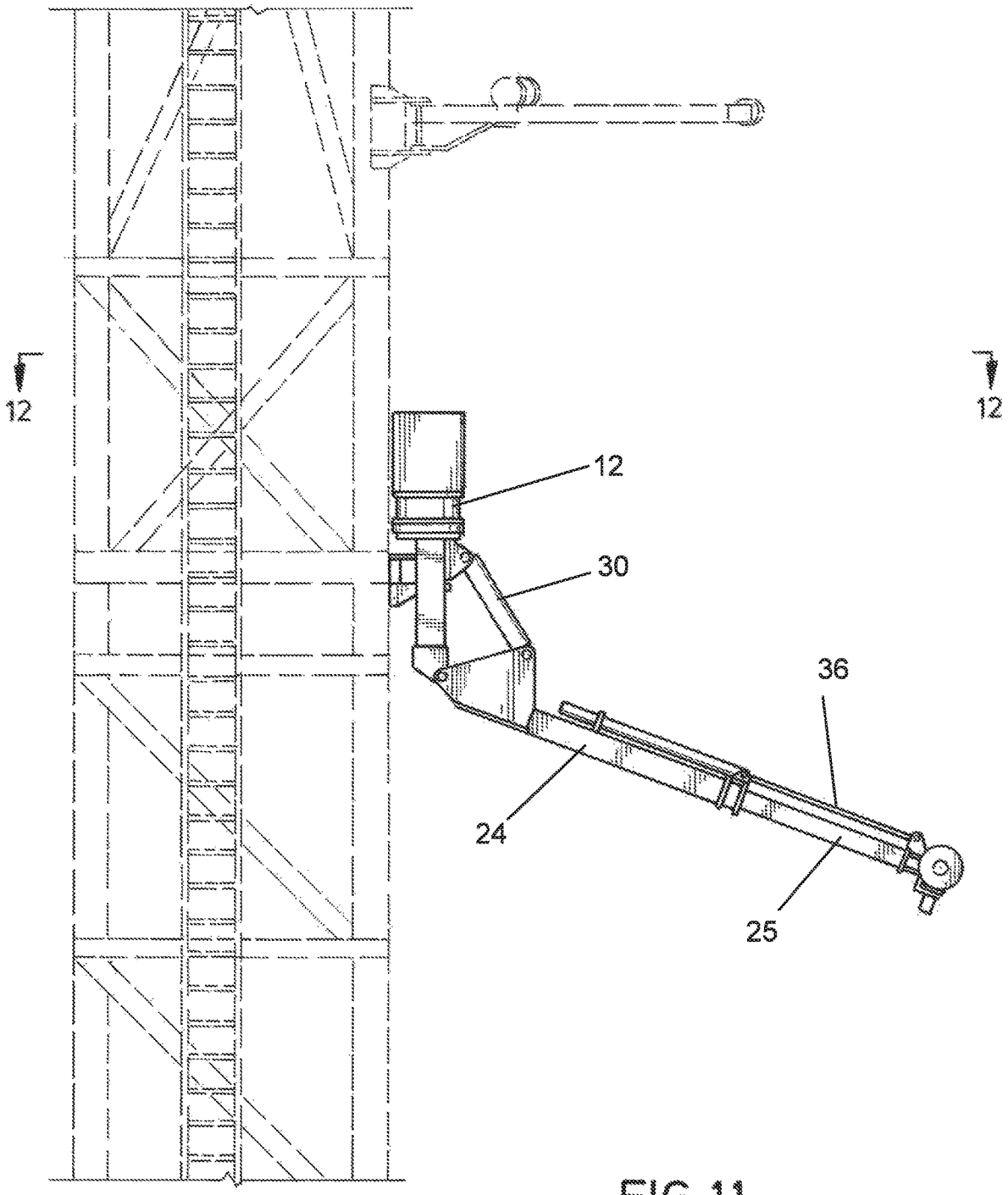
FIG. 11 is an environmental view showing the tailing arm of FIG. 1 in position for receiving pipe from the front side of the rig.
Figure 12:
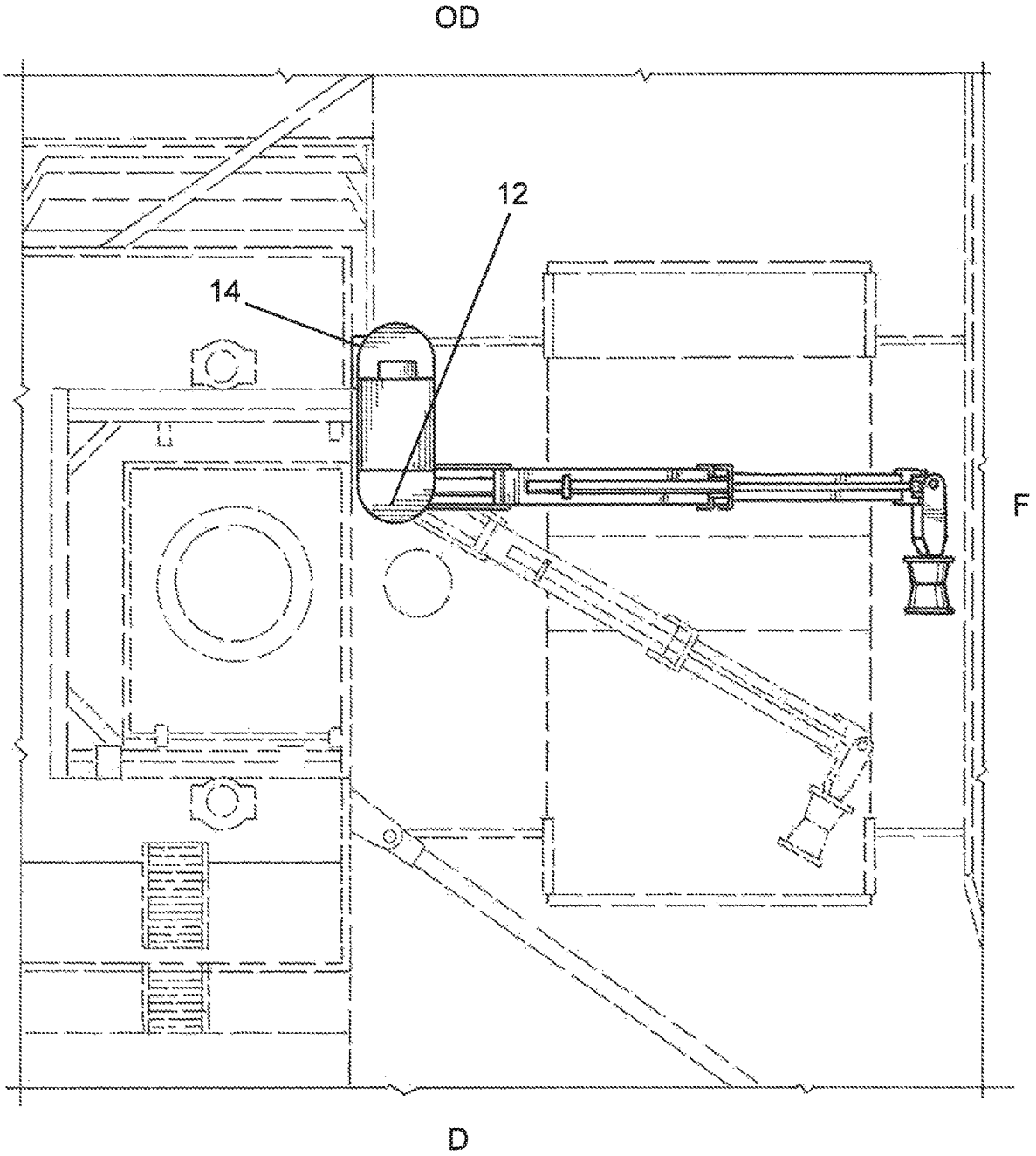
FIG. 12 is a view taken along the lines 12-12 of FIG. 11. The dotted lines show the tailing arm in a position for racking pipe.

Turning to FIGS. 11 and 12 there is shown the tailing arm 10 in position for receiving pipe from the front side F of the rig. Housing 12 is rotated to extend toward the drillers side D. Arm assembly 20 extends toward front side F. Again, when the pipe is lifted to the desired height, piston rod 32 extends to pivot arm assembly downward and guide the pipe on roller 40 into a generally vertical position. FIG. 12 also shows in phantom how arm assembly 20 can be rotated by first rotation assembly 60 to guide the pipe resting on roller 40 to the setback area to be racked. It will be appreciated that FIG. 12 is showing one example of using the tailing arm for racking pipe in a setback. The orientation/configuration of the tailing arm 10 can be changed as needed.

Figure 14:
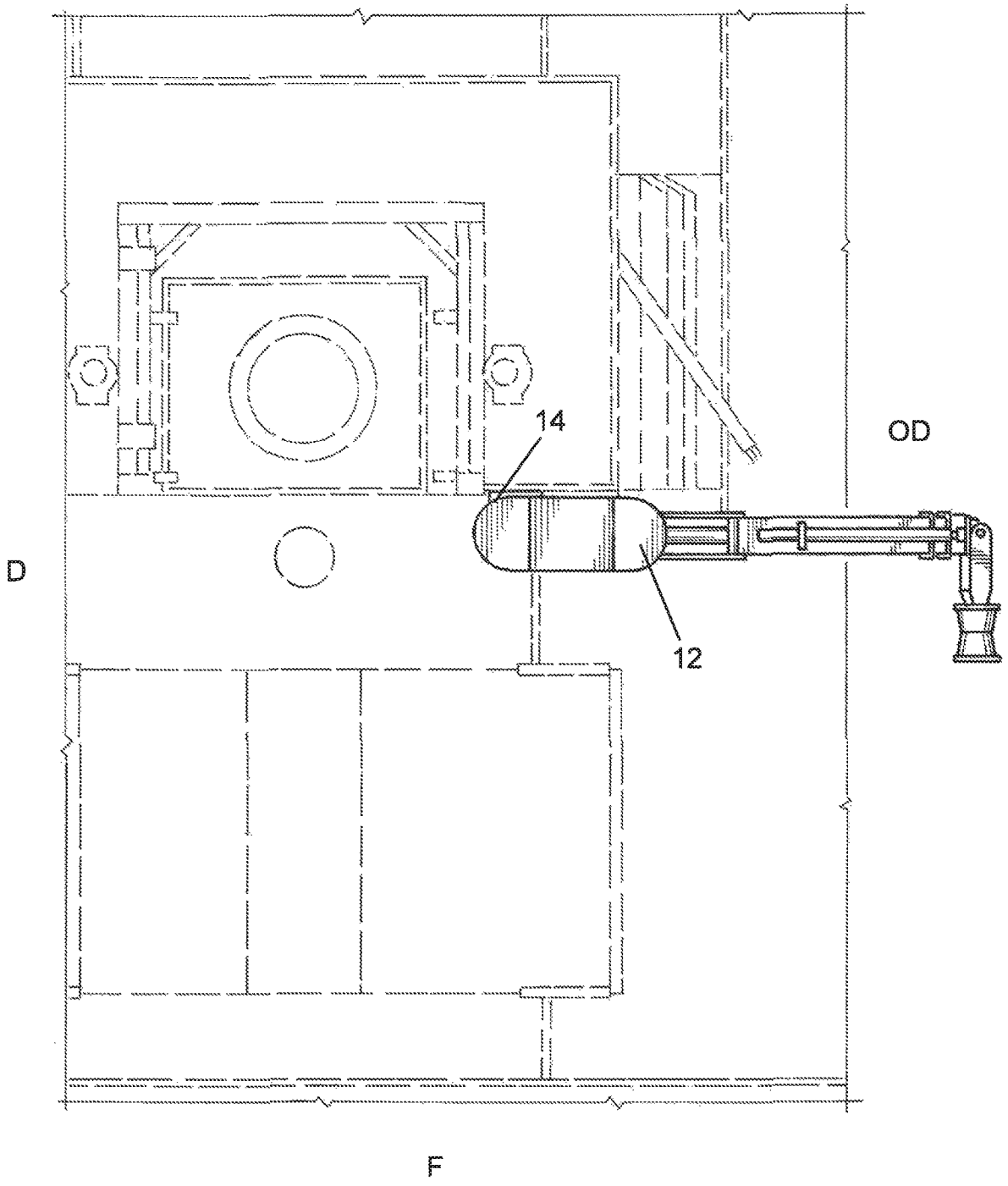
FIG. 14 is a view taken along the lines 14-14 of FIG. 13.

Finally, turning to FIGS. 13 and 14, there is shown the tailing arm 10 in a stored position for rig operations which do not require pipe handling. Unlike prior art tailing arms which are positioned on the rig floor, the tailing arm 10 of the present invention can be moved out of the way of the rig floor. Thus, housing 12 extends out over the off-drillers side OD. Both piston rods 32 and 36 are fully retracted, thereby pulling the arm up and in to its smallest configuration. This allows rig personnel to undertake various activities on the rig floor without interference from tailing arm 10.

Although not shown in the Figures, it will be appreciated that the various parts of the tailing arm assembly of the present invention can be connected to and controlled by a programmable logic controller (PLC), remotely controlled system, or other control system well known to those skilled in the art.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A tailing arm assembly mountable on a mast of a drilling rig, comprising:

a housing having a first end and a second end, said second end adapted to be connected to said mast;

a first arm having a first end and a second end, said first end rotatably connected to said housing proximate said first end of said housing;

a second arm having a first end and a second end, said first end of said second arm being pivotally connected to said second end of said first arm;

a first piston assembly operatively connected to said first and second arms to pivot said second arm relative to said first arm;

a third arm having a first end and a second end, said first end of said third arm pivotally connected to said second end of said second arm;

a pipe-engaging fixture connected to said second end of said third arm;

a first rotation assembly for rotating said first arm relative to said housing; and a second rotation assembly positioned proximate said second end of said housing for rotating said housing relative to said mast about an axis extending through said housing closer to said second end of said housing than said first end of said housing whereby said first end of said housing is moved from a first position to a second position, said second position being circumferentially spaced from said first position;

wherein said first rotation assembly comprises:

a first drive shaft;

a first gear;

a first slewing ring comprising a first inner ring, a first outer ring, and a plurality of first bearings between said first inner and outer rings;

said first arm being operatively connected to said first outer ring;

whereby operation of said drive shaft turns said first gear which engages and turns said first outer ring, thereby turning said first arm.

2. The assembly of claim 1 wherein said second arm comprises an inner telescoping arm.

3. The assembly of claim 2, further comprising:

a second piston assembly operatively connected to said second arm to extend and retract said telescoping arm.

4. The assembly of claim 1, further comprising a mount which connects the housing to said mast.

5. The assembly of claim 4, wherein said second rotation assembly comprises:

a second drive shaft;

a second gear;

a second slewing ring comprising a second inner ring, a second outer ring, and a plurality of second bearings between said second inner and outer rings;

said second outer ring being fixedly connected to said mount;

said housing being operatively connected to said second inner ring;

whereby operation of said second drive shaft turns said second gear which engages and imparts force upon said fixed second outer ring, said force being transferred to said second inner ring to thereby turn said second inner ring and said housing relative to said mast.

6. The assembly of claim 5, further comprising a locking assembly operatively connected to said second rotation assembly comprising:

a piston chamber;

a piston disposed in said piston chamber;

at least one pin extending axially from said piston;

at least one ring bore extending through said second inner ring;

at least one housing bore extending through said lower wall of said housing and in register with said at least one ring bore;

whereby when said piston is actuated, said pin extends through said ring bore and said housing bore and prevents rotation of said second inner ring or said housing.

7. The assembly of claim 6, wherein said locking assembly comprises a plurality of pins extending axially from said piston, and a plurality of ring bores and housing bores through said second inner ring and said lower wall of said housing, respectively.

8. The assembly of claim 3, wherein said first and second piston assemblies are hydraulically actuated.

9. The assembly of claim 1, further comprising an elbow plate pivotally connected between said first arm and said second arm, said first piston assembly being operatively connected to said first arm and said elbow plate.

10. The assembly of claim 1, further comprising a hydraulic rotary actuator operatively connected to said third arm for pivoting said third arm relative to said second arm.

11. The assembly of claim 1, wherein said pipe-receiving fixture comprises a roller.

12. A tailing arm assembly mountable on a mast of a drilling rig, comprising:

a housing having a first end and a second and adapted to be connected to said mast;

a first arm having a first end and a second end, said first end rotatably connected to said housing;

a second arm having a first end and a second end, said first end of said second arm being pivotally connected to said second end of said first arm;

a first piston assembly operatively connected to said first and second arms to pivot said second arm relative to said first arm;

a third arm having a first end and a second end, said first end of said third arm pivotally connected to said second end of said second arm;

a pipe-engaging fixture connected to said second end of said third arm;

a first rotation assembly at least partially disposed in said housing for rotating said first arm relative to said housing; and a second rotation assembly at least partially disposed in said housing for rotating said housing relative to said mast about an axis extending through said housing closer to said second end of said housing than said first end of said housing;

wherein said first rotation assembly comprises:

a first drive shaft;

a first pear;

a first slewing ring comprising a first inner ring, a first outer ring, and a plurality of first bearings between said first inner and outer rings;

said first arm being operatively connected to said first outer ring;

whereby operation of said drive shaft turns said first gear which engages and turns said first outer ring, thereby turning said first arm.

13. A tailing arm assembly mountable on a mast of a drilling rig, comprising:

a housing adapted to be connected to said mast;

a first arm having a first end and a second end, said first end rotatably connected to said housing;

a second arm having a first end and a second end, said first end of said second arm being pivotally connected to said second end of said first arm;

a first piston assembly operatively connected to said first and second arms to pivot said second arm relative to said first arm;

a third arm having a first end and a second end, said first end of said third arm pivotally connected to said second end of said second arm;

a pipe-engaging fixture connected to said second end of said third arm;

a first rotation assembly for rotating said first arm relative to said housing; and a second rotation assembly for rotating said housing relative to said mast;

wherein said first rotation assembly comprises:

a first drive shaft;

a first gear;

a first slewing ring comprising a first inner ring, a first outer ring, and a plurality of first bearings between said first inner and outer rings;

said first arm being operatively connected to said first outer ring;

whereby operation of said drive shaft turns said first gear which engages and turns said first outer ring, thereby turning said first arm.

* * * * *